US009729990B2

(12) United States Patent
Chen et al.

(10) Patent No.: US 9,729,990 B2
(45) Date of Patent: Aug. 8, 2017

(54) MANUFACTURING METHOD OF A CONDENSER MICROPHONE

(71) Applicant: National Tsing Hua University, Hsinchu (TW)

(72) Inventors: Sun-Zen Chen, Dongshan Township, Yilan County (TW); Henry J. H. Chen, Taichung (TW); Jen-Yi Chen, Taipei (TW); Kuan-Hsun Chiu, Taichung (TW); Kuang-Chien Hsieh, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 93 days.

(21) Appl. No.: 14/978,680

(22) Filed: Dec. 22, 2015

(65) Prior Publication Data

US 2016/0112818 A1 Apr. 21, 2016

Related U.S. Application Data

(62) Division of application No. 14/182,820, filed on Feb. 18, 2014, now Pat. No. 9,258,662.

(30) Foreign Application Priority Data

Feb. 18, 2013 (TW) ..... 102105531 A

(51) Int. Cl.
*H01R 31/00* (2006.01)
*H04R 31/00* (2006.01)
(Continued)

(52) U.S. Cl.
CPC ..... *H04R 31/003* (2013.01); *H04R 7/04* (2013.01); *H04R 7/14* (2013.01); *H04R 19/04* (2013.01);
(Continued)

(58) Field of Classification Search
CPC ..... H04R 7/04; H04R 19/005; H04R 19/04; H04R 2231/001; H04R 2217/01; H04R 7/14; H04R 31/003
See application file for complete search history.

(56) References Cited

U.S. PATENT DOCUMENTS 4,700,383 A 10/1987 Takagi et al.
5,573,679 A * 11/1996 Mitchell ..... B81C 1/00595 216/2
(Continued)

FOREIGN PATENT DOCUMENTS

TW 200640278 11/2006
TW 201141245 11/2011

*Primary Examiner* — Paul D Kim
(74) *Attorney, Agent, or Firm* — Muncy, Geissler, Olds & Lowe, P.C.

(57) ABSTRACT

A condenser microphone comprises a substrate, a vibratile diaphragm and a back plate. The substrate has an opening. The diaphragm is disposed corresponding to the substrate and covers the opening, and has a plurality of protrusions. The back plate is coupled to the diaphragm and has a plurality of through holes, at least some of which are corresponding to the protrusions respectively. An interval is formed between the diaphragm and the back plate, and when the diaphragm vibrates, the protrusions move into or further near the through holes.

4 Claims, 4 Drawing Sheets

(51) Int. Cl.
*H04R 7/04* (2006.01)
*H04R 7/14* (2006.01)
*H04R 19/04* (2006.01)

(52) U.S. Cl.
CPC .... *H04R 2217/01* (2013.01); *H04R 2231/001* (2013.01)

(56) References Cited

U.S. PATENT DOCUMENTS

| | | | | |
|---|---|---|---|---|
| 7,146,016 | B2 * | 12/2006 | Pedersen | B81B 3/0072 381/113 |
| 7,301,213 | B2 * | 11/2007 | Matsubara | B06B 1/0292 257/416 |
| 7,329,933 | B2 * | 2/2008 | Zhe | H04R 31/003 181/164 |
| 7,346,178 | B2 * | 3/2008 | Zhe | H04R 31/003 381/174 |
| 7,469,461 | B2 * | 12/2008 | Chang | B81C 1/00182 156/308.2 |
| 7,781,249 | B2 * | 8/2010 | Laming | B81C 1/00158 257/E21.214 |
| 7,856,804 | B2 * | 12/2010 | Laming | B81C 1/00158 257/415 |
| 7,961,897 | B2 | 6/2011 | Weigold | |
| 8,045,734 | B2 * | 10/2011 | Zhe | H04R 31/003 381/174 |
| 2006/0006483 | A1 | 1/2006 | Lee et al. | |
| 2006/0093171 | A1 | 5/2006 | Zhe et al. | |
| 2007/0058825 | A1 | 3/2007 | Suzuki et al. | |
| 2007/0064968 | A1 | 3/2007 | Weigold | |
| 2010/0065930 | A1 | 3/2010 | Nakatani | |
| 2011/0165720 | A1 | 7/2011 | Weigold | |

* cited by examiner

MANUFACTURING METHOD OF A CONDENSER MICROPHONE

CROSS REFERENCE TO RELATED APPLICATIONS

This application is a Divisional of co-pending application Ser. No. 14/182,820 filed on Feb. 18, 2014, now U.S. Pat. No. 9,258,662, which claims priority under 35 U.S.C. §119 (a) on Patent Application No(s). 102105531 filed in Taiwan, Republic of China on Feb. 18, 2013, the entire contents of which are hereby incorporated by reference.

BACKGROUND OF THE INVENTION

Field of Invention

The invention relates to a condenser microphone and a manufacturing method thereof and, in particular, to a condenser microphone and a manufacturing method thereof wherein a plurality of protrusions are disposed on a diaphragm.

Related Art

The microphone is a kind of electronic component capable of converting acoustic signals to electric signals for transmission, belonging to a kind of electro-acoustic transducer. Based on different principles of the electro-acoustic conversion, the microphone is mainly divided into a moving coil type, a condenser type and a piezoelectric type. Among them, the condenser microphone has higher sensitivity, signal-to-noise ratio, lower distortion and better converting efficiency, so it becomes the mainstream of the microphone.

FIG. 1 is a schematic diagram of a conventional condenser microphone. In FIG. 1, the condenser microphone 1 includes a diaphragm 11, a back plate 12 and a substrate 13. The diaphragm 11 is disposed opposite to the back plate 12. The back plate 12 is disposed to the substrate 13 and has a plurality of holes 121. Without coil and magnet, the condenser microphone functions via changing the interval distance between the diaphragm 11 and the back plate 12, and the change of interval causes the capacitance variation that leads to a signal. When a sound wave enters into the condenser microphone 1, the diaphragm 11 is caused to vibrate, so that the interval between the diaphragm 11 and the back plate 12 is changed while the back plate 12 is fixed.

According to the capacitance characteristic, when the interval d between the diaphragm 11 and the back plate 12 is changed, the capacitance value is changed accordingly, and the capacitance value is inversely proportional to the interval d. The interval d is varied according to various oscillation frequencies. On the other hand, the sensitivity of the condenser microphone 1 will show nonlinearity under different acoustic pressures and frequencies, and this nonlinearity results in the distortion of the corresponding acoustic signals. Besides, if the back plate 12 is manufactured firstly, the surface (not shown) will become uneven easily, and therefore, the characteristic of the diaphragm that is made subsequently will not be easily controlled.

The diaphragm 11 is a crucial element of the condenser microphone 1, affecting the quality of the sound sensing. However, the diaphragm 11 of the condenser microphone 1 as shown in FIG. 1 is disposed outside and thus easily impaired by moisture, oxygen and dust, and therefore the effectiveness of the sound sensing is reduced. Furthermore, since the condenser microphone 1 can only sense the capacitance variation between the diaphragm 11 and the back plate 12, the sensitivity thereof is worse.

Therefore, it is an important subject to provide a condenser microphone and a manufacturing method thereof wherein the diaphragm can be prevented from being affected by moisture, oxygen and dust, the sensitivity is improved, and the production yield and product reliability can be increased.

SUMMARY OF THE INVENTION

In view of the foregoing subject, an objective of the invention is to provide a condenser microphone and a manufacturing method thereof wherein the diaphragm can be prevented from being affected by moisture, oxygen and dust while the device sensitivity is improved and the production yield and product reliability is increased.

To achieve the above objective, a condenser microphone according the invention comprises a substrate, a diaphragm and a back plate. The substrate has an opening. The diaphragm is disposed corresponding to the substrate and covers the opening, and has a plurality of protrusions. The back plate is coupled to the diaphragm and has a plurality of through holes, at least some of which are corresponding to the protrusions respectively. An interval is formed between the diaphragm and the back plate, and when the diaphragm vibrates, the protrusions move into or further near the through holes.

In one embodiment, the protrusions don't enter into the through holes when the diaphragm doesn't vibrate; otherwise, the protrusions enter into the through holes respectively when the diaphragm doesn't vibrate.

In one embodiment, the protrusion has a rectangular, circular, triangular, cylindrical, taper, inverse taper or intendedly-designed form.

In one embodiment, when one of the protrusions enters into (or further approaches) one of the through holes, the protrusion and the through hole have an overlap height. That is, the protrusion of the diaphragm at least partially enters into the through hole of the back plate.

In one embodiment, the condenser microphone further comprises a dielectric layer, which is disposed between the diaphragm and the back plate.

In one embodiment, the condenser microphone further comprises at least an insulating layer, which is disposed between the substrate and the diaphragm.

To achieve the above objective, a manufacturing method of a condenser microphone according to the invention comprises steps of: providing a substrate; forming a diaphragm having a plurality of protrusions on the substrate; forming a sacrifice layer on the diaphragm and covering the protrusions; disposing a back plate covering the sacrifice layer and maybe partially coupled to the diaphragm; forming a plurality of through holes in the back plate, wherein at least some of the through holes are corresponding to the protrusions respectively; and removing the sacrifice layer.

In one embodiment, the diaphragm and its protrusions are disposed on the substrate via the method of injection, hot embossing, adhering or integration forming.

In one embodiment, after the step of providing the substrate, the manufacturing method further comprises a step of disposing at least an insulating layer on the substrate.

In one embodiment, after the step of forming the sacrifice layer on the diaphragm and covering the protrusions, the manufacturing method further comprises a step of forming a dielectric layer on the sacrifice layer.

In one embodiment, the sacrifice layer is removed by an etching method, such as a wet etching performed by an etchant or the like.

As mentioned above, in the condenser microphone of this invention, at least some of the through holes of the back plate are disposed corresponding to a plurality of protrusions of the diaphragm. So, when the diaphragm vibrates, the protrusions can move into or further near the through holes. Thereby, the interval between the diaphragm and the back plate is changed, which causes a capacitance variation (the first corresponding part). Besides, the overlap heights of the protrusions and the corresponding through holes also generate another capacitance variation (the second corresponding part). Therefore, the sensitivity (especially the linearity of the sensitivity) of the condenser microphone can be increased, and the distortion in processing acoustic signals can be decreased. Furthermore, in the manufacturing process of the condenser microphone, the diaphragm is made prior to the back plate. Therefore, the characteristic of the diaphragm is more easily controlled, and the back plate can protect the diaphragm, so that the condenser microphone is not affected by moisture, oxygen and dust. Thereby, the production yield and product reliability of the condenser microphone can be increased a lot.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
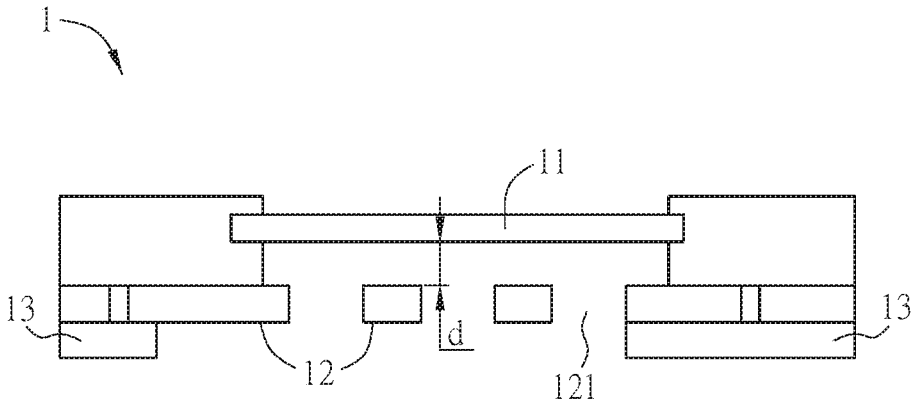
FIG.1 (Prior Art)
FIG. 1 is a schematic diagram of a conventional condenser microphone.
Figure 2:
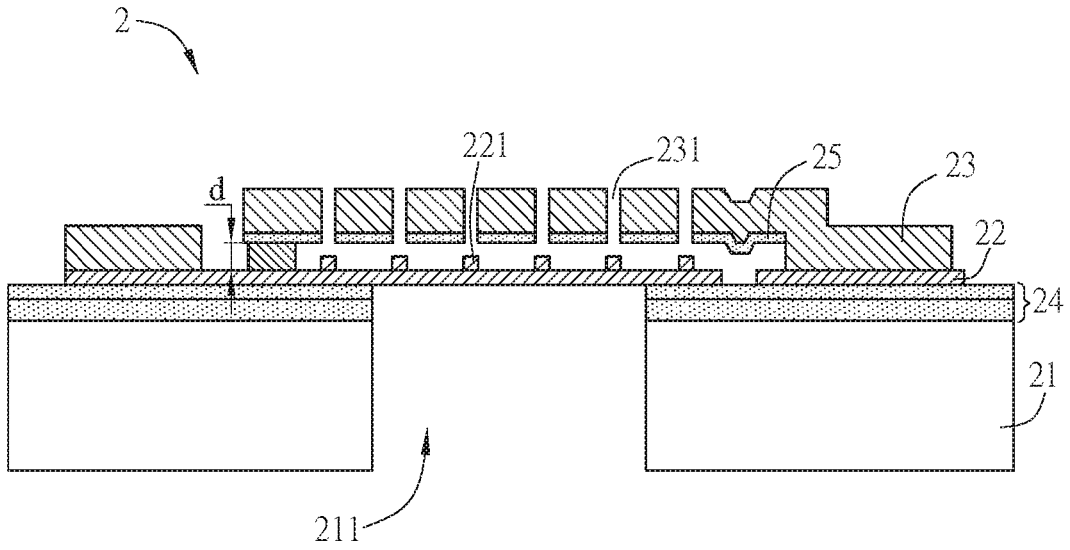
FIG. 2 is a schematic diagram of a condenser microphone according to a preferred embodiment of the invention.
Figure 3A:
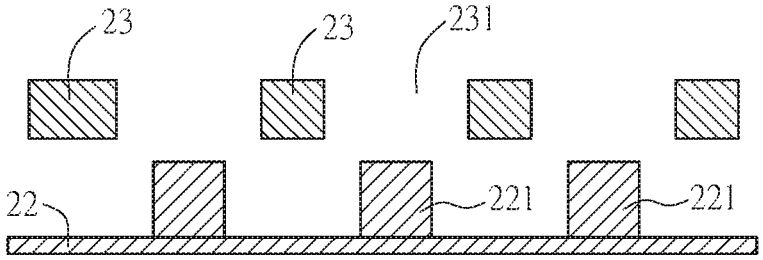
FIG. 3A shows the diaphragm and the back plate in FIG. 2 when the diaphragm doesn't vibrate.
Figure 3B:
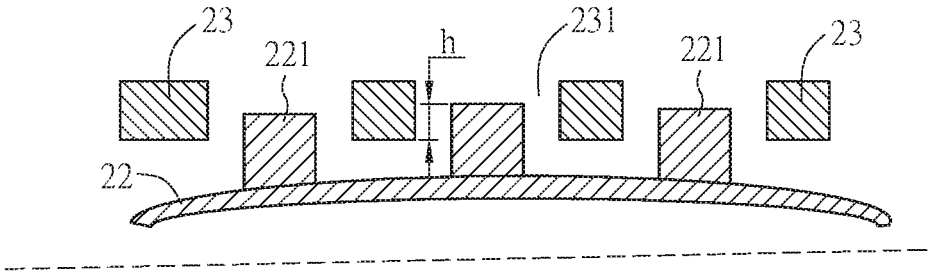
FIG. 3B shows the diaphragm and the back plate in FIG. 2 when the diaphragm vibrates.

FIG. 2 is a schematic diagram of a condenser microphone according to a preferred embodiment of the invention, FIG. 3A shows the diaphragm and the back plate in FIG. 2 when the diaphragm doesn't vibrate, and FIG. 3B shows the diaphragm and the back plate in FIG. 2 when the diaphragm vibrates. As shown in FIGS. 2, 3A and 3B, the condenser microphone 2 includes a substrate 21, a diaphragm 22 and a back plate 23. The substrate 21 has an opening 211. The substrate 21 is, for example, a silicon substrate, a glass substrate or a sapphire substrate.

The diaphragm 22 is disposed corresponding to the substrate 21 and covers the opening 211. The diaphragm 22 can be made by conductive material. The diaphragm 22 has a plurality of protrusions 221. The diaphragm 22 and its protrusions 221 can be fabricated via injection, hot embossing, adhering or integration forming.

The protrusion 221 can have a regular or irregular shape, such as a rectangular, circular, triangular, cylindrical, taper, inversely taper or intendedly-designed shape. The protrusions 221 can have the same shape or different ones. Besides, the protrusions 221 can be evenly or unevenly spaced with each other. The protrusions 221 can be arranged into a regular pattern such as a concentric circle, an array, a radial pattern or a triangular pattern, or into an irregular pattern. In this embodiment, the protrusions 221 of the diaphragm 22 have rectangular shapes for example, and they are evenly spaced with each other.

The back plate 23 is coupled to the diaphragm 22, and an interval d is formed between the back plate 23 and the diaphragm 22. The back plate 23 can be made by polysilicon or metal material. The back plate 23 has a plurality of through holes 231, which are respectively or partially disposed corresponding to the protrusions 221. In this embodiment, a through hole 231 is disposed corresponding to a protrusion 221. In other embodiments, a through hole can be disposed corresponding to two protrusions. The number of the through hole and protrusion disposed corresponding to each other and the arrangement thereof can be adjusted according to the actual requirements. In this embodiment, the protrusions 221 will not enter into the through holes 231 (as shown in FIG. 3A) when the diaphragm 22 doesn't vibrate, for example. In other embodiments, some of the protrusions may enter into the through holes when the diaphragm 22 doesn't vibrate (not shown).

When the diaphragm 22 vibrates due to the acoustic wave, the interval d between the diaphragm 22 and the back plate 23 is changed and thus the protrusions 221 move into or further near the through holes 231. In this embodiment, the protrusions 221 move into the corresponding through holes 231 for example, but the invention is not limited thereto. The cross-section of the vibrating diaphragm 22 is curving-form (as shown in FIG. 3B), and therefore the movements of the protrusions 221 to the through holes 231 are different since the protrusions 221 located on the diaphragm 22 differently. In a horizontal view, when a protrusion 221 moves into a through hole 231, the protrusion 221 overlaps the through hole 231 by an overlap height h. In other embodiments, a surface of the back plate 23 adjacent to the diaphragm 22 can be also configured with protrusions (not shown), and thereby the overlap height between the protrusion of the diaphragm and the through hole can be increased when the protrusion of the diaphragm moves into the through hole.

Specifically, when the diaphragm 22 doesn't vibrate (as shown in FIGS. 2 and 3A), an interval d is formed between the diaphragm 22 and the back plate 23. When the diaphragm 22 vibrates by receiving the acoustic wave (as shown in FIG. 3B), the interval d is changed and a capacitance variation $\Delta C1$ is obtained therefore. Meanwhile, since the protrusions 221 move into the through holes 231 and an overlap height h is formed between the respective protrusions 221 and through holes 231, a capacitance variation $\Delta C2$ is further obtained. Accordingly, the condenser microphone 2 of this invention can generate two capacitance variations, i.e. $\Delta C1$ and $\Delta C2$, and thereby the sensitivity of the condenser microphone 2 is improved. Besides, because the capacitance variation $\Delta C2$ is proportional to the overlap height h, the sensitivity of the condenser microphone 2 is further improved and the total harmonic distortion thereof is decreased.

Furthermore, because the back plate 23 is disposed more outside than the diaphragm 22 (which means the back plate 23 is disposed on a side nearer to the user, the side of the source of the acoustic wave), the back plate 23 can protect the diaphragm 22, so that the condenser microphone 2 is not affected by moisture, oxygen and dust. Thereby, the production yield and product reliability of the condenser microphone 2 can be increased a lot.

In FIG. 2, the condenser microphone 2 further includes at least an insulting layer 24, which is disposed between the substrate 21 and the diaphragm 22. In this embodiment, the condenser microphone 2 has two insulating layers 24 for example, but this invention is not limited thereto. Besides, the condenser microphone 2 further includes a dielectric layer 25, which is disposed between the diaphragm 22 and the back plate 23. To be noted, the portion of the insulating layer 24 corresponding to the opening 211 can be removed, if necessary, so that the better performance and higher SNR can be obtained.

Figure 4:
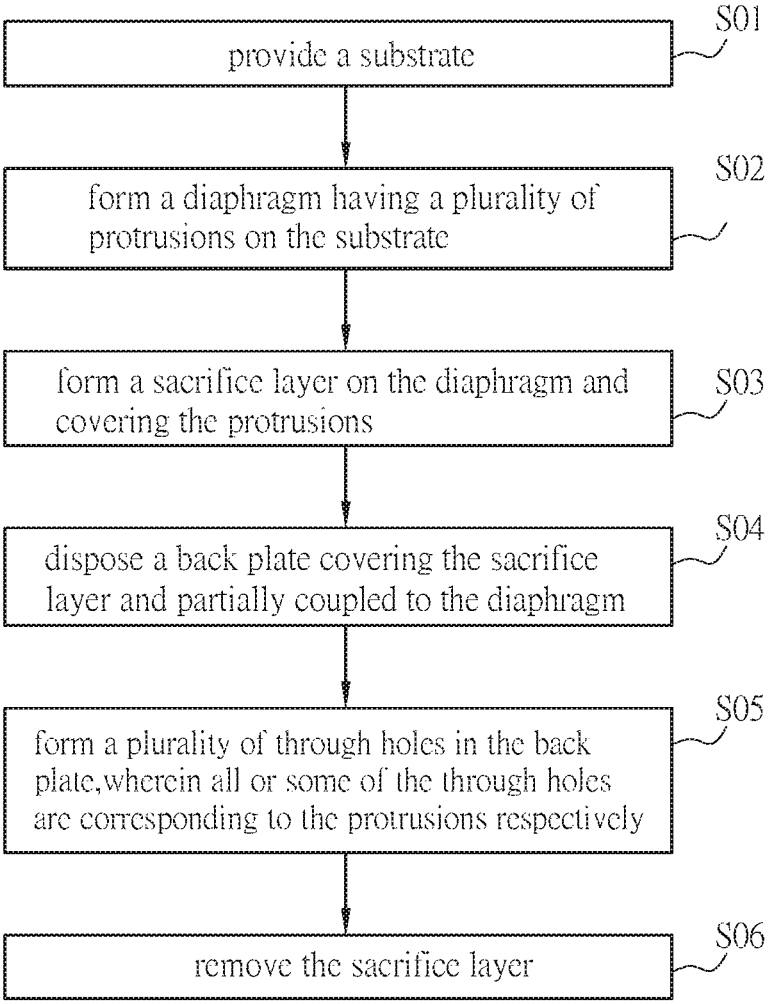
FIG. 4 is a flow chart of a manufacturing method of a condenser microphone according to a preferred embodiment of the invention.
Figure 5:
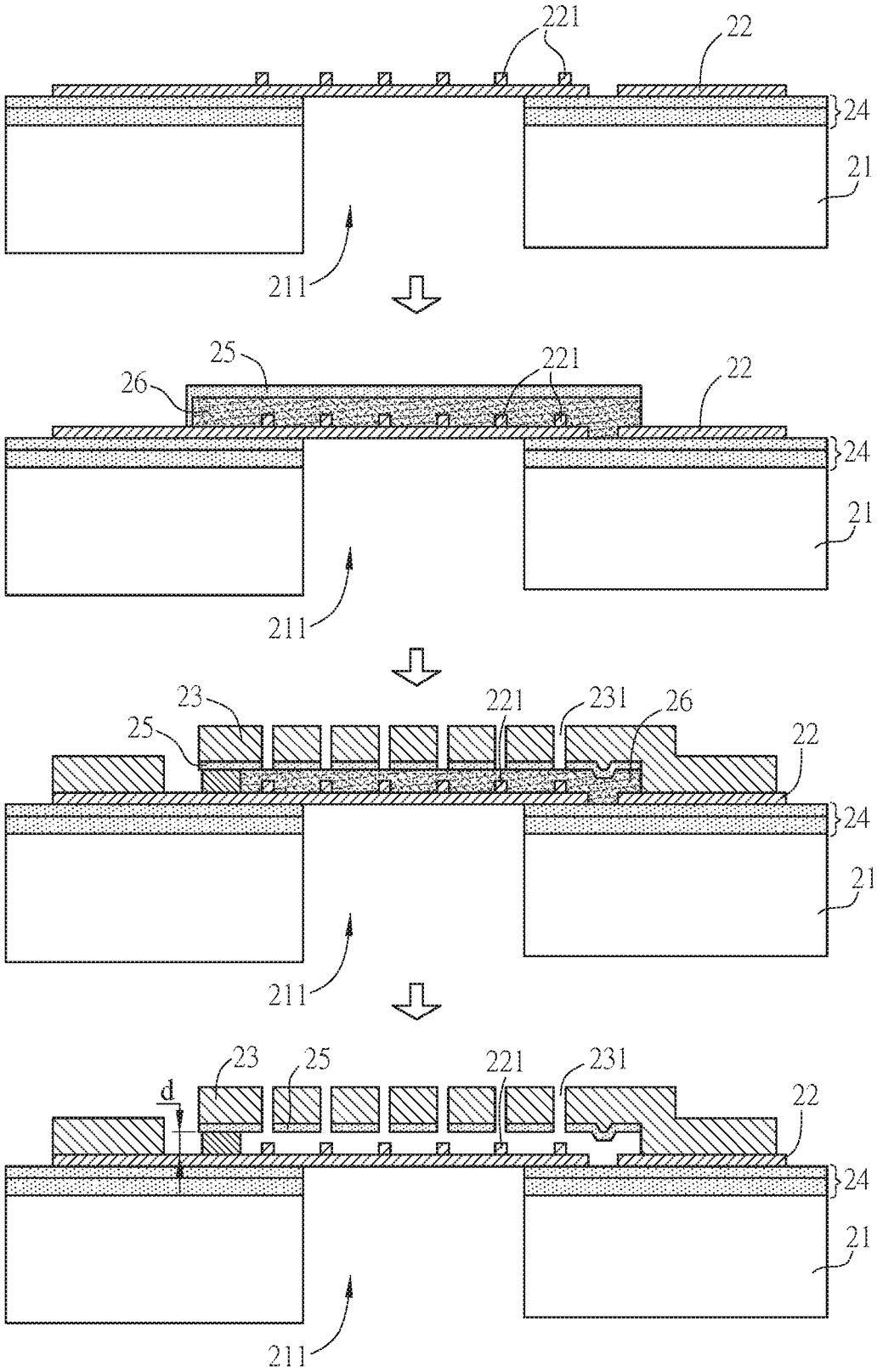
FIG. 5 is a schematic diagram showing the manufacturing method of the condenser microphone according to a preferred embodiment of the invention.

FIG. 4 is a flow chart of a manufacturing method of a condenser microphone according to a preferred embodiment of the invention, and FIG. 5 is a schematic diagram showing the manufacturing method of the condenser microphone according to a preferred embodiment of the invention. As shown in FIGS. 4 and 5, the manufacturing method of this embodiment includes the steps S01 to S06 for manufacturing the condenser microphone 2 in FIG. 2 for example.

The step S01 is to provide a substrate 21. The substrate 21 is, for example, a silicon substrate, a glass substrate or a sapphire substrate. After the step of providing the substrate 21, an opening 211 can be formed in the substrate 21. To be noted, the step of forming an opening can be set following the step S02. Besides, after the step of providing the substrate 21, an insulating layer 24 can be formed on the substrate 21, and two insulating layers 24 are disposed on the substrate 21 for example. However, the invention is not limited thereto.

The step S02 is to form a diaphragm 22 having a plurality of protrusions 221 on the substrate 21. The diaphragm 22 is disposed on the substrate 21 correspondingly and covers the opening 211. The diaphragm 22 has a plurality of protrusions 221. The diaphragm 22 and its protrusions 221 can be fabricated via injection, hot embossing, adhering or integration forming. The protrusion 221 can have a regular or irregular shape, such as a rectangular, circular, triangular, cylindrical, taper, inversely taper or intendedly-designed shape. The protrusions 221 can have the same shape or different shapes. Besides, the protrusions 221 can be evenly or unevenly spaced with each other. The protrusions 221 can be arranged into a regular pattern such as a concentric circle, an array, a radial pattern or a triangular pattern, or into an irregular pattern. In this embodiment, the protrusions 221 of the diaphragm 22 have rectangular shapes for example, and they are evenly spaced with each other.

To be noted, the portion of the insulating layer 24 corresponding to the opening 211 can be removed, if necessary, so that the better performance and higher SNR can be obtained. The step of removing the portion of the insulating layer 24 corresponding to the opening 211 can be implemented in the step S01 or S02 or the following step. Herein for example, the portion of the insulating layer 24 corresponding to the opening 211 is removed after the step S02.

The step S03 is to form a sacrifice layer 26 on the diaphragm 22 and covering the protrusions 221. The sacrifice layer 26 covers the protrusions 221. After the step S03, a dielectric layer 25 can be further formed on the sacrifice layer 26.

The step S04 is to dispose a back plate 23 covering the sacrifice layer 26 and partially coupled to the diaphragm 22. The back plate 23 is made by poly-silicon or metal material for example.

The step S05 is to form a plurality of through holes 231 in the back plate 23, wherein all or some of the through holes 231 are corresponding to the protrusions 221 respectively. In this embodiment, a through hole 231 is disposed corresponding to a protrusion 221. In other embodiments, a through hole can be disposed corresponding to two protrusions. Otherwise, some of the protrusions are disposed corresponding to the through holes, and the other protrusions are not disposed corresponding to the through holes. The number of the through hole and protrusion disposed corresponding to each other and the arrangement thereof can be adjusted according to the actual requirements.

The step S06 is to remove the sacrifice layer 26. In this embodiment, the sacrifice layer 26 is removed by an etching method, such as a wet etching performed by an etchant. After removing the sacrifice layer 26, an interval d is formed between the back plate 23 and the flat of the diaphragm 22. When the diaphragm 22 vibrates due to the acoustic wave, the protrusions 221 can move upward and downward through the through holes 231. Since the diaphragm 22 and the back plate 23 are illustrated clearly in the above embodiments, they are not described here for conciseness.

To be noted, in the manufacturing process of the condenser microphone 2, the diaphragm 22 is made prior to the back plate 23. Therefore, the characteristic of the diaphragm 22 is more easily controlled. Besides, the back plate 23 can protect the diaphragm 22, so that the condenser microphone 2 is not affected by moisture, oxygen and dust. Thereby, the production yield and product reliability of the condenser microphone 2 can be increased a lot.

In summary, in the condenser microphone of this invention, at least some of the through holes of the back plate are disposed corresponding to a plurality of protrusions of the diaphragm. So, when the diaphragm vibrates, the protrusions can move into or further near the through holes. Thereby, the interval between the diaphragm and the back plate is changed, which causes a capacitance variation (the first corresponding part). Besides, the overlap heights of the protrusions and the corresponding through holes also generate another capacitance variation (the second corresponding part). Therefore, the sensitivity (especially the linearity of the sensitivity) of the condenser microphone can be increased, and the distortion in processing acoustic signals can be decreased. Furthermore, in the manufacturing process of the condenser microphone, the diaphragm is made prior to the back plate. Therefore, the characteristic of the diaphragm is more easily controlled, and the back plate can protect the diaphragm, so that the condenser microphone is not affected by moisture, oxygen and dust. Thereby, the production yield and product reliability of the condenser microphone can be increased a lot.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A manufacturing method of a condenser microphone, comprising steps of:

providing a substrate;

forming a diaphragm having a plurality of protrusions on the substrate;

forming a sacrifice layer on the diaphragm and covering the protrusions;

disposing a back plate covering the sacrifice layer and partially coupled to the diaphragm;

forming a plurality of through holes in the back plate, wherein at least some of the through holes are corresponding to the protrusions respectively; and removing the sacrifice layer.

2. The manufacturing method as recited in claim 1, wherein the diaphragm and its protrusions are fabricated via injection, hot embossing, adhering or integration forming, on the substrate.

3. The manufacturing method as recited in claim 1, wherein after the step of providing the substrate, the manufacturing method further comprises a step of:

disposing at least an insulating layer on the substrate.

4. The manufacturing method as recited in claim 1, wherein after the step of forming the sacrifice layer on the diaphragm and covering the protrusions, the manufacturing method further comprises steps of:

forming an dielectric layer on the sacrifice layer; and removing the sacrifice layer by an etching method.

* * * * *